US011492763B2

(12) United States Patent
Bösterling et al.

(10) Patent No.: US 11,492,763 B2
(45) Date of Patent: Nov. 8, 2022

(54) TENSION CLAMP AND FASTENING POINT FOR THE FASTENING OF A RAIL TO THE GROUND

(71) Applicant: Vossloh-Werke GmbH, Werdohl (DE)

(72) Inventors: Winfried Bösterling, Neuenrade (DE); Duo Liu, Dortmund (DE)

(73) Assignee: Vossloh-Werke GmbH, Werdohl (DE)

( * ) Notice: Subject to any disclaimer, the term of this patent is extended or adjusted under 35 U.S.C. 154(b) by 216 days.

(21) Appl. No.: 16/349,449

(22) PCT Filed: Nov. 9, 2017

(86) PCT No.: PCT/EP2017/078781
§ 371 (c)(1),
(2) Date: May 13, 2019

(87) PCT Pub. No.: WO2018/091351
PCT Pub. Date: May 24, 2018

(65) Prior Publication Data

US 2019/0338470 A1 Nov. 7, 2019

(30) Foreign Application Priority Data

Nov. 16, 2016 (DE) ..... 10 2016 122 062.0
May 30, 2017 (DE) ..... 10 2017 111 781.4

(51) Int. Cl.
*E01B 9/30* (2006.01)
*E01B 9/48* (2006.01)

(52) U.S. Cl.
CPC ..... *E01B 9/303* (2013.01); *E01B 9/483* (2013.01); *E01B 2201/00* (2013.01)

(58) Field of Classification Search
CPC ..... E01B 9/303; E01B 9/483; E01B 2201/00; E01B 9/00; E01B 9/28; E01B 9/30;
(Continued)

(56) References Cited

U.S. PATENT DOCUMENTS 3,640,460 A 2/1972 Baseler
5,096,119 A 3/1992 Schultheiss et al.
(Continued)

FOREIGN PATENT DOCUMENTS

DE 1023062 B * 1/1958 ..... E01B 9/303
DE 1023062 B 1/1958
(Continued)

OTHER PUBLICATIONS

"Rail fastening systems", Vossloh AG, https://www.vossloh.com/en/products-and-solutions/products-at-a-glance/schienenbefestigungs-systeme/, (downloaded from the Internet Jun. 24, 2019).
(Continued)

*Primary Examiner* — Zachary L Kuhfuss
*Assistant Examiner* — Cheng Lin
(74) *Attorney, Agent, or Firm* — The Webb Law Firm

(57) ABSTRACT

The invention relates to a tension clamp for the holding of a rail for rail vehicles and a rail fastening point. The tension clamp has a central section having two legs, two torsional sections connected thereto and leading away laterally in an outwards direction having a supporting zone, and two supporting arms connected to the torsional sections. The supporting arms run to the front face of the tension clamp and have a spring section and a support section with a supporting zone. The fact that the support sections point laterally in an outwards direction such that the straight lines which in each case connect the centers of the supporting zones and the torsional section allocated to the supporting arm in an area on the rear face of the tension element increases the natural frequencies of the tension clamp such that they are outside of stimulation frequencies that occur in practice.

11 Claims, 5 Drawing Sheets

(58) Field of Classification Search
CPC ..... E01B 9/32; E01B 9/34; E01B 9/44; E01B 9/46; E01B 9/48; E01B 9/60; E01B 9/62; E01B 2201/08; E01B 2205/00
See application file for complete search history.

(56) References Cited

U.S. PATENT DOCUMENTS

| | | | | |
|---|---|---|---|---|
| 5,522,542 | A * | 6/1996 | Ciecielski | E01B 9/483 238/352 |
| 7,854,392 | B2 | 12/2010 | Hauschild et al. | |
| 8,777,122 | B2 * | 7/2014 | Bosterling | E01B 9/68 238/287 |
| 9,139,959 | B2 | 9/2015 | Bosterling et al. | |
| 9,297,122 | B2 | 3/2016 | Bosterling et al. | |
| 2008/0237363 | A1 | 10/2008 | Hauschild et al. | |
| 2010/0200666 | A1 | 8/2010 | Bosterling et al. | |
| 2012/0187206 | A1 | 7/2012 | Bosterling et al. | |
| 2016/0244919 | A1 | 8/2016 | Wiethoff et al. | |
| 2019/0284765 | A1 * | 11/2019 | Bosterling | E01B 9/303 |

FOREIGN PATENT DOCUMENTS

| | | | | |
|---|---|---|---|---|
| DE | 1784462 | B1 | 8/1971 | |
| EP | 2478154 | B1 | 1/2016 | |
| ES | 1064713 | U * | 4/2007 | E01B 9/40 |
| FR | 1326483 | A | 5/1963 | |
| JP | S4517686 | | 7/1970 | |
| JP | H03129001 | A | 6/1991 | |
| KR | 20140000963 | U | 2/2014 | |
| KR | 2020140001109 | A | 8/2014 | |
| KR | 20150000643 | A | 1/2015 | |
| KR | 20150000643 | A * | 1/2015 | E01B 9/303 |
| WO | WO-03046285 | A2 * | 6/2003 | E01B 9/303 |
| WO | 2005010277 | A1 | 2/2005 | |
| WO | 2006005543 | A1 | 1/2006 | |
| WO | 2010091725 | A1 | 8/2010 | |
| WO | 2011032932 | A1 | 3/2011 | |
| WO | 2011110456 | A1 | 9/2011 | |
| WO | 2012059374 | A1 | 5/2012 | |
| WO | 2014029705 | A1 | 2/2014 | |
| WO | 2015051841 | A1 | 4/2015 | |

OTHER PUBLICATIONS

"System W 41 U—Highly elastic rail fastening for conventional rail and high speed—the universal solution for ballasted track with grooveless concrete sleepers", Vossloh AG, https://media.vossloh.com/media/01_product_finder/vfs/system_w_41_u/Vos_Produktbroschuere_Sys-W-41-U_EN.pdf, 2014, (downloaded from the Internet Jun. 24, 2019).

"System W 21—Highly elastic rail fastening for high speed and conventional rail—the modern solution for ballasted track with concrete sleepers", Vossloh AG, https://media.vossloh.com/media/01_product_finder/vfs/system_w_21/Vos_Produktbroschuere_Sys-W21_EN.pdf, 2015, (downloaded from the Internet Jun. 24, 2019).

"System 300—Highly elastic rail fastening for high speed and conventional rail—the established solution for the slab track", Vossloh AG, https://media.vossloh.com/media/01_product_finder/vfs/system_300/Vos_Produktbroschuere_Sys-300_EN.pdf, 2015, (downloaded from the Internet Jun. 24, 2019).

Steger, "Optimisation of the dynamic behaviour of rail fastenings", Der Eisenbahn-Ingenieur, 2016, (Abstract only).

* cited by examiner

TENSION CLAMP AND FASTENING POINT FOR THE FASTENING OF A RAIL TO THE GROUND

CROSS-REFERENCE TO RELATED APPLICATIONS

This application is the United States national phase of International Application No. PCT/EP2017/078781 filed Nov. 9, 2017, and claims priority to German Patent Application Nos. 10 2016 122 062.0 filed Nov. 16, 2016, and 10 2017 111 781.4 filed May 30, 2017, the disclosures of which are hereby incorporated by reference in their entirety.

BACKGROUND OF THE INVENTION

The invention relates to a tension clamp for fastening a rail for rail vehicles.

The invention further relates to a fastening point in which a rail for a rail vehicle is fastened to a ground.

The ground on which a fastening point according to the invention is established is typically a sleeper or plate made of a solid material such as concrete or similar. The fastening point according to the invention can, however, also be mounted on conventional wooden sleepers serving as the ground.

The rails fastened by means of the components and fastening points improved by the invention usually have a rail foot, a rail web on the rail foot and a rail head borne by the rail web.

Several variants of fastening points of the type under discussion here and systems for comprising the components under discussion here for the manufacture of fastening points of this type are known. Examples of such systems are presented in the Applicant's published brochures, available for download for example via the URL http://www.vossloh-fastening-systems.com/de/produkte_2015/anwendungs-bereiche/conventional_rail/conventional_rail_1. html. The brochures "System W 41 U—highly elastic rail fastening, highly elastic rail fastening for conventional and high speed—the universal solution for ballasted track with grooveless concrete sleepers", version of September 2014, the brochure "System W 21—highly elastic rail fastening for conventional and high speed—the modern solution for ballasted track with grooveless concrete sleepers", version of February 2015 or the brochure "System 300 Highly elastic rail fastening for conventional and high speed—the proven solution for slab tracks", version of February 2015 should be mentioned by way of an example.

The known rail fastening systems (see for example WO 2006/005543 A1 and the other patent publications mentioned below) and rail fastening points made from these each typically comprise, as the component from which they are composed, a guide plate (see for example WO 2010/091725 A1) provided for the lateral guiding of the rail, a W-shaped tension clamp provided to be placed on the guide plate (see for example WO 2012/059374 A1) and a tensioning element (see for example WO 2014/029705 A1) provided to tension the tension clamp against the ground (see for example WO 2006/005543 A1).

Elastic rail pads (see for example WO 2005/010277 A1) can optionally be added to these basic components of rail fastening systems, base plates (see for example WO 2011/110456 A1) to adjust the height of the rails about the ground or for the large-scale distribution of the loads that occur when a railway vehicle drives over the rails, which elastic rail pads are also placed under the rails or the other plate-shaped components of the system in order to ensure a certain flexibility of the rails in at the fastening point formed from the system in each case in the direction of the force of gravity, as can isolator elements (see for example WO 2015/051 841 A1), which are typically placed between the spring element and the foot of the rail to be fastened in order to ensure optimized electrical insulation against the ground.

The W-shaped or w-shaped tension clamps are generally formed in one piece and bent from a spring steel wire in one move. They have a central section which is usually V-shaped or U-shaped with two legs arranged in parallel to one another. These legs delimit between them an open space through which the tensioning means, typically a sleeper screw or a sleeper bolt, is guided into the ground with its shaft. The legs are usually connected to one another at one end by means of a base section that points towards the front face of the tension clamp allocated to the rail. A torsional section is typically formed on the other end of the legs of the central section, which torsional section protrudes in a lateral, outwards direction from the respective allocated leg of the central section.

The torsional sections are curved in the direction of the lower face of the tension clamp such that the spring element can be supported on a contact area in the region of the torsional sections in a supporting zone formed on the respective torsional section during use, which contact area is formed on the upper face of the component that bears the spring element, for example a guide plate. The ends of the torsional sections that face away from the central section generally pass into a supporting arm in each case, which supporting arm when viewed from the side is typically curved in an arch-like manner in the direction of the upper face of the tension clamp and when viewed from above is aligned in the direction of the front face of the rail to be fastened. The free end sections of the supporting arms typically point in the direction of the central section. The tension clamp is supported on the foot of the rail to be fastened with these end sections during use.

Supporting zones are formed on the lower face of the end sections by means of which the end sections lie on the rail foot during use. The supporting zones of the supporting arms and the torsional sections are regularly aligned in a straight line which is essentially parallel to the symmetrical axis of the tension clamp in the tension clamps known from practice.

An example of a tension clamp set out above, used in practice and designated "Skl15", is described in the above-mentioned brochure "System 300 highly elastic rail fastening for conventional and high speed—the proven solution for slab tracks".

Beyond the shape of the supporting arms and the shape and alignment of their end sections, the elastic flexibility and associated with this the holding force exerted on the rail by means of the supporting arms can be adjusted to the requirements and loads that occur during practical use. In the same way, the spring behavior of the tension clamp can be affected by the design of the torsional sections and of the central section and any transition sections between the central section and the torsional sections and between the torsional sections and the supporting arms.

The guide plates generally have form elements on their upper faces on which the spring element to be arranged on the respective guide plate is guided such that it retains its position during use even under the loads that occur in practice. For example, fluted recesses in which the torsional sections of the spring element sit during use or a central web on the upper face of the guide plate can be designed on which the central loop is guided and supported.

It has been found that the service life of tension clamps depends significantly on their vibration behavior. It is known that tension clamps generally have several natural frequencies.

In practical use, the tension clamps are stimulated to vibrate when a train drives over the rails held by the tension clamps. Periodically, recurrent errors on the rails or on the edges of the rail vehicle can lead to resonance peaks. If these are close to one of the natural frequencies of the tension clamps, there is a dramatic increase in the vibration amplitude, particularly in the region of the supporting arms of the tension clamp. This results in a premature and sudden failure of the tension clamp as a result of a break that typically occurs in the region of the torsional sections or in the transition area of the supporting arms in the direction of the torsional sections.

In an article published in the journal EI—Der Eisenbahningenieur, August 2016, page 25 ff., by Maximilian Steiger, studies on the optimization of the dynamic behavior of rail fasteners are reported. As a result of these tests, three measures to avoid damage to rail fastenings as a result of resonances were proposed.

The first of the measures proposed consisted of the arrangement of adding further vibration-absorbing elements to the tension clamp. These disc-shaped or tube-like additional elements should in particular be arranged in the region of the supporting arms. However, the test also showed that vibration absorbers of this type were highly effective but susceptible to destruction, so the article came to the conclusion that the practical usability of absorbers of this type is questionable.

As a second measure, the article proposed widening the contact surfaces provided for the tension clamp on the respective guide plate. The test showed that widened supports enable the natural frequencies of the tension clamps to be increased to the point that they are outside the range in which stimulation typically occurs in practice. The relative movements that are necessarily exerted by the tension clamp and the guide plate when the rail guided in a lateral direction by the guide plate and held by the tension clamp is driven over as a result of the unavoidable horizontal and vertical movements of the rails that occur in practice proved, however, to be problematic. These movements resulted in increased wear in the region of the broadened supports, calling into question the feasibility of the proposed widening of the supports.

The third measure proposed by the article was a change to the shape of the tension clamp itself. This measure also aims to increase the natural frequency of the tension clamp to a range outside of the stimulation that occurs in practice. The shape of the supporting arm and the distance between the supporting arms and what is known as the "tilt axis" of the supporting arms was recognized as a critical design feature. In this context, the straight lines that connect the center of the zone with which the free end of the respective supporting arm is supported on the rail foot during use to the center of the zone in which the other end of the respective supporting arm is supported on the guide plate are designated the tilt axes of the supporting arms. This zone is typically in the region of the torsional section allocated to the respective supporting arm. Reducing the distance between the curve described by the supporting arm and the tilt axis, in other words decreasing the height of the curve above the guide plate meant the natural frequencies were in turn able to be increased sufficiently.

However, the decrease in the shape and in particular the curve height of the supporting arms is associated with a fundamental change in the spring properties. This can be to the extent that the tension clamp can no longer be optimally used for the respective purpose or no longer meets the requirements placed on it in terms of elastic behavior in an optimal manner.

Against this background, the object has arisen to identify practical measures for the design of one or a plurality of interacting components for a rail fastening point with the aim of maximizing the life of the system formed from the components or of its individual components.

SUMMARY OF THE INVENTION

To achieve this object, the invention proposes specific designs of a tension clamp or a guide plate which are generally indicated herein, wherein each of these design measures achieves the object individually, in other words isolated from the other measures of the object set out above, and therefore leads to an improvement in the vibration behavior of the overall system and in particular the tension clamps installed in this system. It is of course understood that the measures proposed by the invention can be combined with one another in any way in order to achieve an optimized effect.

Advantageous embodiments of the invention are defined in the disclosure and, like the general concept of the invention, are explained in detail in the following.

A fastening point according to the invention is accordingly characterized in that a tension clamp designed according to the invention or a guide plate designed according to the invention is installed within it. Here too it is of course understood that the tension clamp according to the invention and the guide plate according to the invention each individually lead to a clear improvement in the vibration behavior, in other words can be used as alternatives to one another but provide an optimal result when used in combination with one another.

A measure that is essential to the invention and particularly effective in terms of the problem addressed here to improve the vibration behavior of the tension clamp itself therefore lies in displacing the zone with which the supporting arm in question lies on the rail foot in each of the supporting arms of the tension clamp such that the natural frequency is shifted to a range in which vibration stimulation no longer occurs in practical use.

In order to do this, the invention proposes a tension clamp for the elastic holding of a rail for rail vehicles, the rail comprising a foot, a web on said foot and a rail head borne by the web, which in a known manner has

- a loop-shaped central section, with two legs and a base section that connects the legs to one another, wherein the free end face of the base section faces the front face, the free upper face of the central section faces the upper face of the tension clamp and the legs of the central section face with their ends, which face away from the base section, the rear face of the tension clamp,
- two torsional sections, one of which in each case is connected to an end of one of the legs of the central section that faces away from the base section, wherein the torsional sections lead away laterally in an outwards direction in each case starting from the leg that is allocated to them respectively and wherein the torsional sections have a supporting zone on their lower face by means of which the tension clamp is supported on the component that bears them during use, and two supporting arms, one of which in each case is connected to the end of one of the torsional sections that faces away from the allocated leg of the central section, wherein the supporting arms run in the direction of the front face of the tension clamp and in each case have a spring section curved towards the upper face of the tension clamp and a support section that ends at the free end of the supporting arm, the lower face of which support section has a supporting zone by means of which the supporting arm in question is supported on the foot of the rail to be fastened during use, According to the invention, the support sections of the supporting arms each point laterally outwards relative to the central section of the tension clamp such that when the tension clamp is viewed from above the straight lines that connect the center of the supporting zones of the supporting arms to the center of the supporting zone of the torsional section allocated to the respective supporting arm intersect in an area located on the rear face of the tension clamp.

Surprisingly, it has been demonstrated that the fact that in a tension clamp according to the invention the supporting zones of the support sections of the supporting arms and the torsional section to which the respective supporting arm is connected are no longer in parallel to the symmetrical axis of the tension clamp but instead are on a straight line that includes an acute angle running in the direction of the rear face of the tension clamp with this symmetrical axis means that the natural frequencies of the tension clamp can effectively be increased high enough that they are significantly outside the stimulation frequencies that occur in practical use. The durability of the tension clamp is significantly improved by the invention without this leading to a significant change in the spring behavior. The invention therefore removes the problems that occurred in previous practice without a fundamental redesign of the components of a rail fastening system being necessary.

The invention of course does not rule out that the measures proposed in the prior art with respect to optimized dynamic behavior of the tension clamp (see for example the article mentioned above by Maximilian Steiger) being implemented in a tension clamp according to the invention in order to achieve further optimized vibration behavior building on the design according to the invention. This includes in particular the decrease in the height of the curve of the supporting arms above the contact surface on which the tension clamp is mounted and the widening of the support zones by means of which the support sections of the supporting arms sit on the rail foot during use.

The straight lines that run between the support sections allocated to one another by the centers of the supporting zones and the torsional sections preferably enclose an angle of at least 60° when the tension clamp is viewed from above, in particular more than 60° or at least 90°, in particular more than 90° in order to create a distance between the natural frequencies of the tension clamp and a possible stimulant frequency that is as great as possible. In terms of the spring effect of the tension clamp, it has proven to be advantageous if the angle enclosed between the straight lines when the tension clamp is viewed from above is a maximum of 120°, in particular less than 120°.

The alignment of the supporting arms selected can contribute to the shifting of the natural frequencies of a tension clamp according to the invention as an optional design element. In terms of the desired shift in natural frequency, it can be expedient if the supporting arm runs in an outwards direction from the central section from the torsional section allocated to it when the tension clamp is viewed from above. In other cases, it was surprisingly demonstrated that the shift in natural frequency is optimal if the supporting arm, when the tension clamp is in turn viewed from above, runs in an inward direction towards the base section of the central section from the torsional section allocated to it. This applies in particular if the supporting arm, when also viewed from above, runs in a straight line over at least part of the length of its spring sections. In terms of the vibration behavior of the tension clamp, this design enables favorable radii to be created in the transition from the legs of the central section to the torsional section connected to them and from the torsional sections to the supporting arm connected to it in each case.

In terms of the producibility and durability of a tension clamp according to the invention, it is also advantageous of, also optionally, the spring section of the supporting arms passes into the allocated support section in a continuous curved line in each case.

If, in turn optionally, the supporting zone of the supporting arms when the tension arm is viewed from above protrudes in the direction of the front face of the tension clamp relative to the free front face of the base section of the central section, this can also contribute to the durability and the optimal spring behavior of a tension clamp according to the invention.

Vibration behavior of tension clamps shaped according to the invention that is particularly well adapted to the conditions that occur in practice is achieved if the following applies to the distance AS between the center of the supporting zones of the supporting arms and the point of intersection of the straight lines that in each cease connect the center of the supporting zones of the supporting arms to the center of the supporting zones of the torsional section allocated to the respective supporting arm that is measured in parallel to the symmetrical axis of the tension clamp and for the distance AG between the supporting zones of the supporting arms and the centers of the supporting zones of the torsional sections also measured in parallel to the symmetrical axis:

$$1.2 \times AG \leq AS \leq 1.8AG.$$

It has proven to be particularly expedient in practice if the following applies:

$$1.3 \times AG \leq AS \leq 1.7AG.$$

In line with the explanations above, a fastening point according to the invention, in which fastening point a rail for a rail vehicle is fastened to the ground the rail comprising a foot, a web that is on said foot and a rail head borne by the web, includes a guide plate that acts against the lateral edge of the foot of the rail for the lateral guiding of the rail and a tension clamp that is positioned on the guide plate, which tension clamp is supported on the foot of the rail by the free end sections of its supporting arms in order to exert an elastic holding force on the rail. In this case, the tension clamp is designed according to the invention.

To tension the tension clamp, a fastening point according to the invention can comprise a tensioning element in a known manner, such as a sleeper screw or a sleeper bolt, by means of which the tension clamp is tensioned against the ground. The tensioning element in question is typically guided through the space delimited between the legs of the central section of the tension clamp and through an opening in the guide plate below this and into the ground, where it is anchored. The anchoring can occur in an also known manner by means of a dowel embedded in the ground or by means of another appropriate fastening.

An insulating element being arranged between the end sections of the supporting arms of the tension clamp and the rail foot can also contribute to protecting the tension clamp installed in a fastening point for a rail of the type under discussion here, which insulating element insulates the tension clamp electrically against the rail foot and consists of a dampening or elastically flexible material at least in sections. The insulator can for example be designed as a sandwich element in which electrically insulating layers are combined with dampening or elastic layers in order to achieve on the one hand the necessary electrical insulation and on the other hand a separation of the rails from the tension clamp due to vibration while ensuring sufficient resistance against the holding forces exerted by the tension clamp. The measures mentioned here that relate to the insulating element contribute in and of themselves, in other words independently of the design features according to the invention set out above, to an improvement in the durability of the tension lamp used in a rail fastening point but of course have a particularly advantageous effect in the design of a fastening point according to the invention.

A further component that is used in fastening points of the type under discussion here is an elastic intermediate layer that is generally arranged between the rail foot and the ground to give the support for the rails a certain flexibility in the direction of the force of gravity. The adaptation of the dampening behavior of the elastic intermediate layer to the stimulation frequencies that occur in practice can also contribute to excessive stimulation of the tension clamp in the range of its natural frequencies being avoided.

BRIEF DESCRIPTION OF THE DRAWINGS

The invention is explained in more detail in the following with reference to a drawing illustrating exemplary embodiments: Shown schematically is the following.

DESCRIPTION OF THE INVENTION

Figure 1:
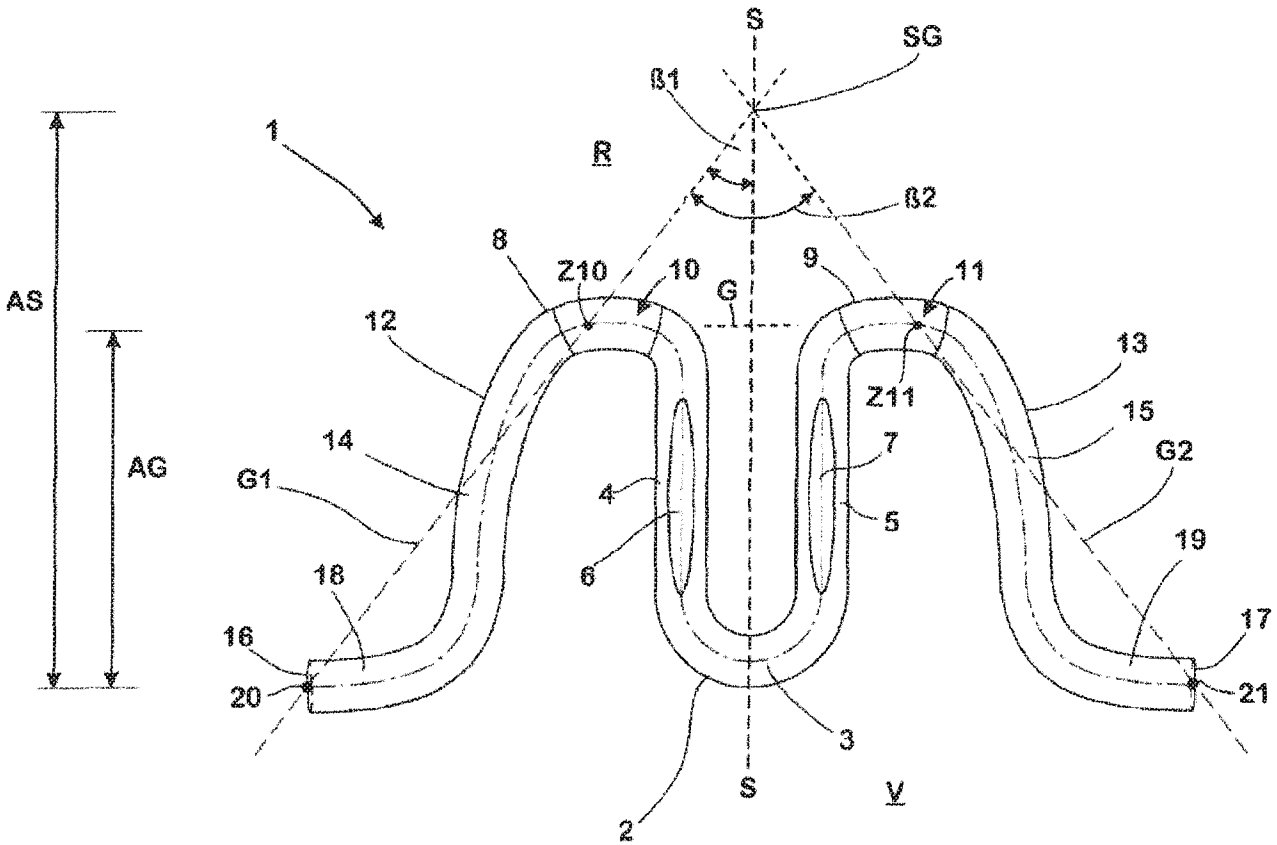
FIG. 1 a view of a tension clamp according to the invention from above.
Figure 3:
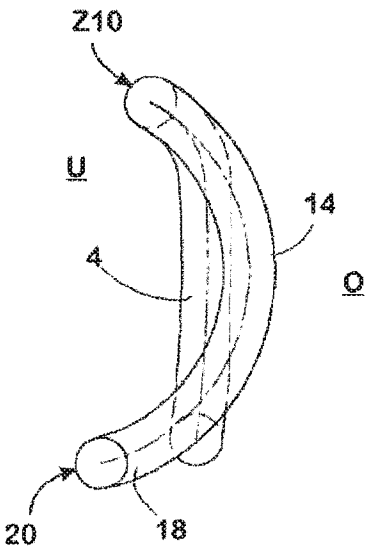
FIG. 3 a lateral view of the tension clamp according to FIG. 1 and FIG. 2.
Figure 2:
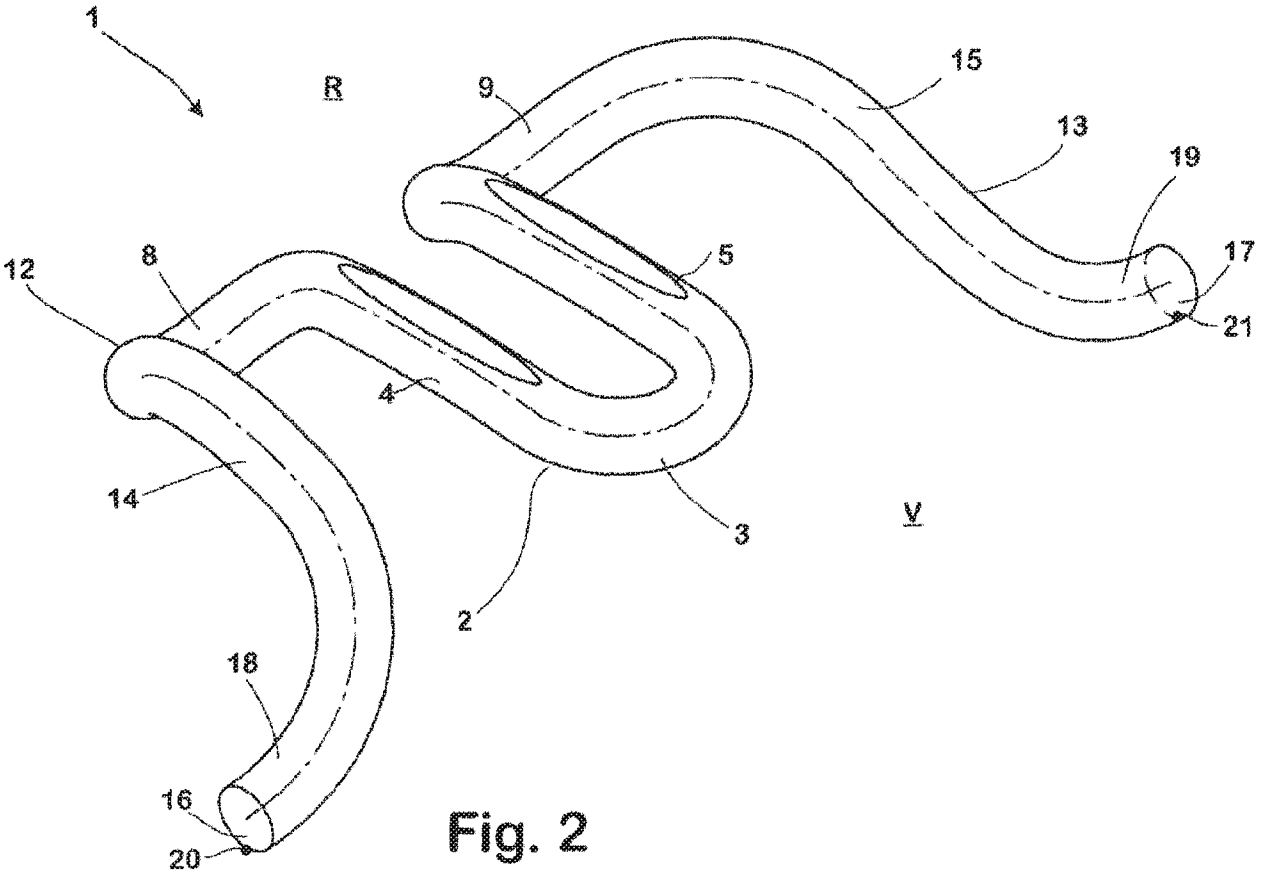
FIG. 2 a perspective view of the tension clamp according to FIG. 1 from the front.

The tension clamp 1 according to the invention that is shown in FIGS. 1-3 and curved into a single piece from a spring wire with a circular cross section has a U-shaped central section 2 having a base section 3 allocated to the front face V of the tension clamp and straight legs 4, 5 connected to said base section. Flattened contact surfaces 6, 7 are provided on the upper face of the legs 4, 5 of the central section 2 allocated to the upper face O of the tension clamp 1, on which contact surfaces a sleeper screen sits with its screw head as a tensioning element to tension the tension clamp 1 during use (not shown).

The legs 4, 5 of the central section 2 each pass into a torsional section 8, 9 of the tension clamp 1 on the ends that point away from the base section 3 and towards the rear face R of the tension clamp 1. The torsional sections 8, 9 are curved in the direction of the lower face U of the tension clamp 1 and lead in a lateral direction outwards from the respective allocated legs 4, 5. The lower face of each of the torsional sections 8, 9 has a supporting zone 10, 11 by means of which they sit on a contact surface of a guide plate during use.

A supporting arm 12, 13 is connected to the end of the torsional sections 8, 9 that points away from the central section 2 in each case. The supporting arms 12, 13 are designed to be curved in an arch-like manner in the region of their spring sections 14, 15 in the direction of the upper face O of the tension clamp 1 and run from the respective torsional section 8, 9 in the direction of the front face V of the tension clamp 1. They are aligned such that when viewed from above (FIG. 1) the distance of the supporting arms 12, 13 starting from the torsional sections 8, 9 measured in parallel to the connection lines G between the centers Z10, Z11 of the supporting zones 10, 11 is widened in each case.

The free ends 16, 17 of the supporting arms 12, 13 each end in a support section 18, 19 which connects to the respective spring section 14, 15 with which the supporting arm 12, 13 sits in the rails to be fastened in the respective rail fastening point on the foot (not shown) during use. Punctiform supporting zones 20, 21 are formed in each case on the lower face of the support sections 18, 19 allocated to the lower face U of the tension clamp 1 on the ends 16, 17 of the supporting arms 12, 13.

The support sections 18, 19 are shaped in a continuous curve starting from the respective spring section 14, 15 from the central section 2 laterally in an outwards direction such that they are nestled tangentially to a straight line aligned in parallel to the connection lines G. The length of the supporting arms 12, 13 is dimensioned such that the punctiform supporting zones 20, 21, when viewed from above (FIG. 1), lie in front of the base section 3 of the central section 2 in the direction of the front face V of the tension clamp 1.

As a result of the outwards-facing arrangement of the support sections 18, 19 and the corresponding lateral external punctiform supporting zones 20, 21 of the supporting arms 12, 13, the connection lines G1, G2, which on the one side (connection line G1) connect the center Z10 of the supporting zone 10 of the torsional section 8 to the punctiform supporting zone 20 which therefore also reflects the center of the supporting arm 12 connected to the torsional section 8 and on the other side (connection line G2) connects the center Z11 of the supporting zone 11 of the torsional section 9 to the punctiform supporting zone 21 which therefore also reflects the center of the supporting arm 13 connected to the torsional section 9 are arranged at an acute angle ß1 relative to the symmetrical axis S of the tension clamp 1 and enclose an angle ß2 of around 70°. Accordingly, when viewed from above (FIG. 1) they intersect at a point of intersection SG that lies behind the rear face R of the tension clamp 1.

The distance AS between the punctiform supporting zones 20, 21 that form their own center of the supporting arms 12, 13 measured in parallel to the symmetrical axis S on the one side and the point of intersection SG on the other side corresponds to around 1.5 times the distance AG of the punctiform supporting zones 20, 21 from the centers Z10, Z11 of the supporting zones 10, 11 of the torsional sections 8, 9 that is also measured in parallel to the symmetrical axis S. In practice, the distance AG can for example be approximately 100 mm and the distance AS approximately 150 mm, wherein the distance AS can also be varied in a range from for example 130 mm to 170 mm if this is expedient with respect to the setting of the natural frequencies or on the basis of structural circumstances.

Figure 4:
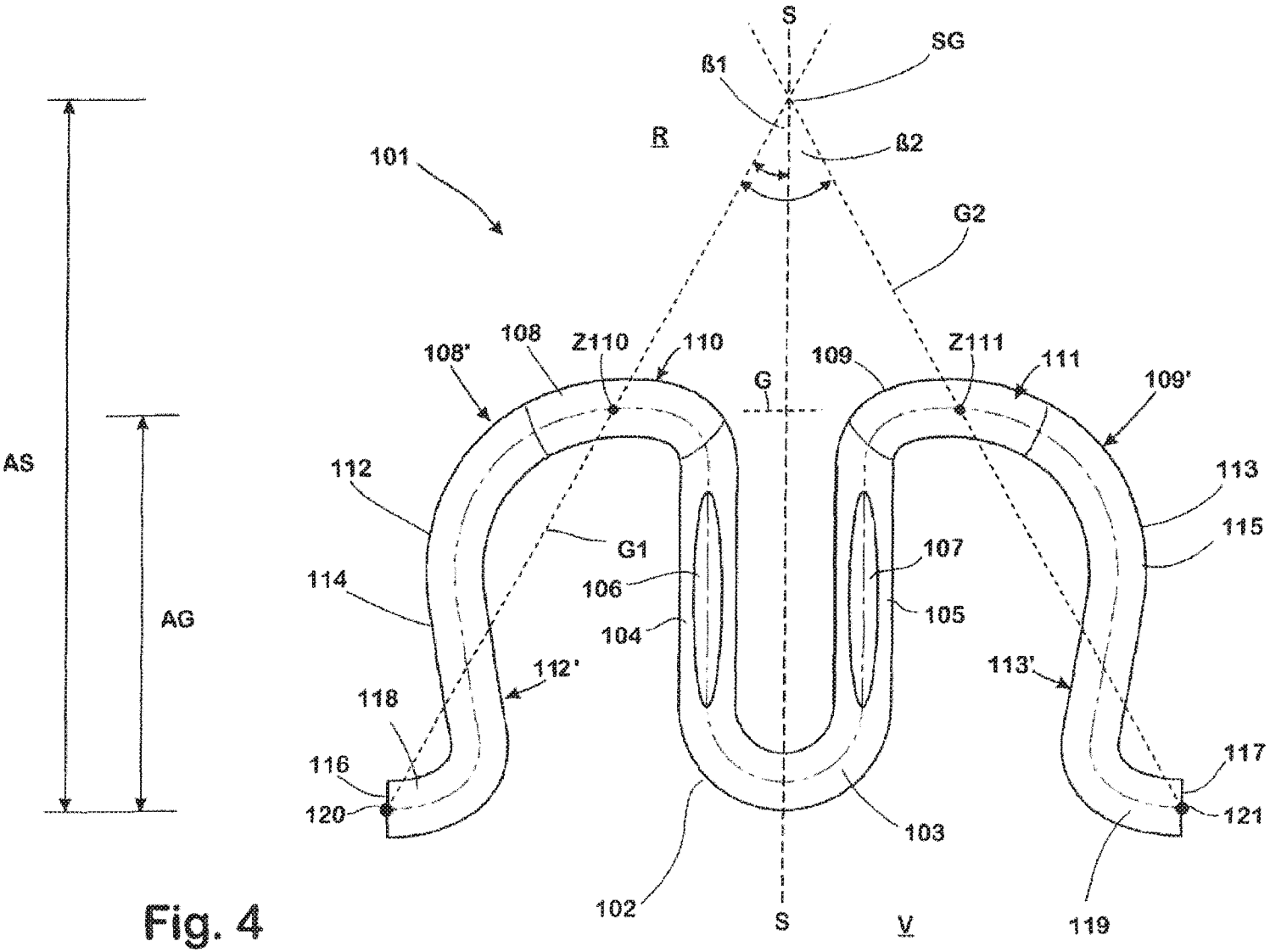
FIG. 4 a view of a second tension clamp according to the invention from above.
Figure 5:
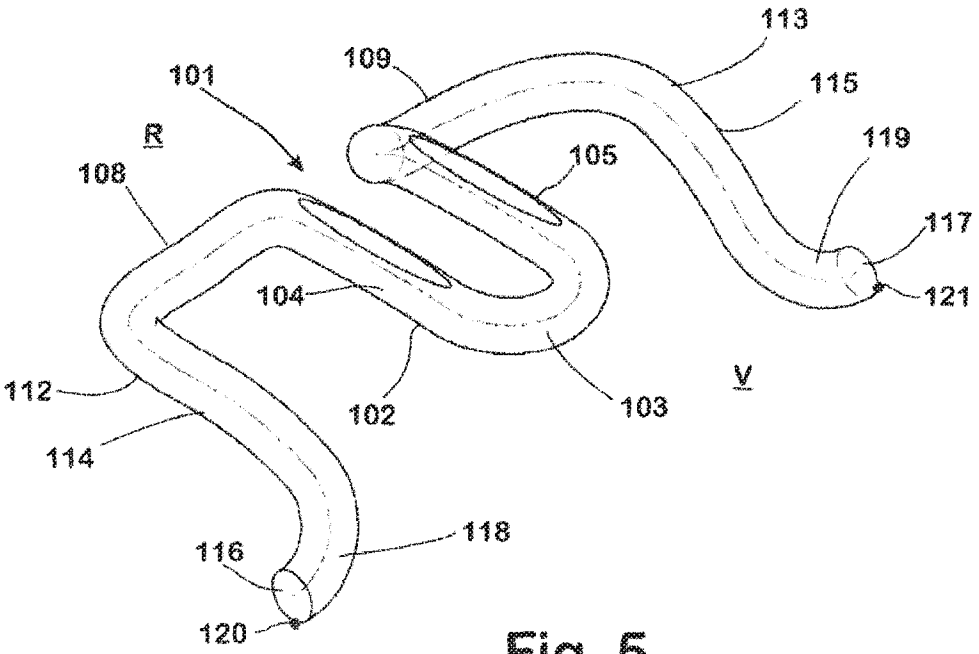
FIG. 5 a perspective view of the tension clamp according to FIG. 4 from the front.
Figure 6:
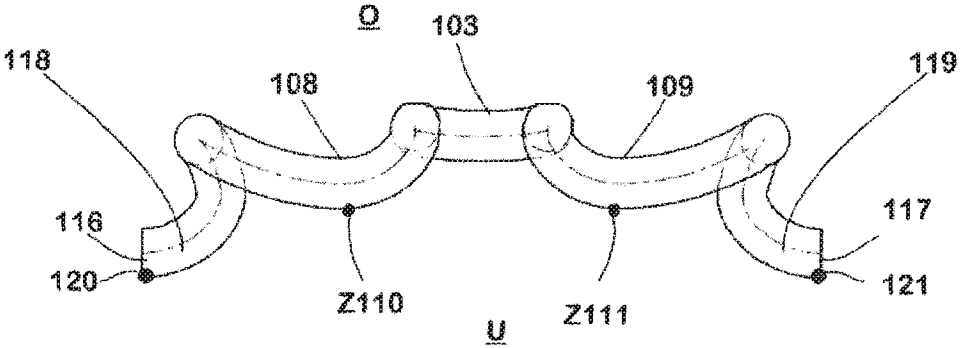
FIG. 6 a perspective view of the tension clamp according to FIG. 4 and FIG. 5 from the back.
Figure 7:
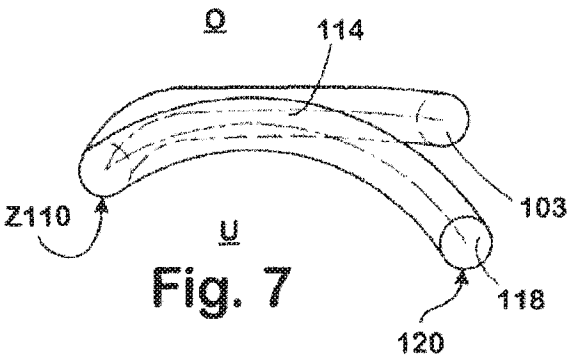
FIG. 7 a lateral view of the tension clamp according to FIGS. 4-6.

Practical tests have shown that the tension clamp 1 has a natural frequency that is at least 50% higher than to a conventionally shaped tension clamp 101 as shown in FIGS. 4 and 5. This is so high that even under unfavorable conditions of use, for example in tunnels or on bridges, there will not be any stimulation of the tension clamp 1 in the range of its natural frequencies.

The tension clamp 101 according to the invention that is shown in FIGS. 4-7 and curved into a single piece from a spring wire with a circular cross section has a U-shaped central section 102 having a base section 103 allocated to the front face V of the tension clamp 1 and straight legs 104, 105 connected to said base section. Flattened contact surfaces 106, 107 are provided on the upper face of the legs 104, 105 of the central section 102 allocated to the upper face O of the tension clamp 101, on which contact surfaces a sleeper screen sits with its screw head as a tensioning element to tension the tension clamp 101 during use (not shown).

The legs 104, 105 of the central section 102 each pass into a torsional section 108, 109 of the tension clamp 101 on the ends that point away from the base section 103 and towards the rear face R of the tension clamp 101. The lower face of each of the torsional sections 108, 109 has a supporting zone 110, 111 by means of which they sit on a contact surface of a guide plate during use.

The torsional sections 108, 109 are curved in the direction of the lower face U of the tension clamp 101 and lead in a lateral direction outwards from the respective allocated legs 104, 105. Starting from the respective leg 104, 105, the respective torsional section 108, 109 runs in a narrower curve than in tension 1 initially in the direction of the lower face U of the tension clamp 101 and then in a further curve in an outwards direction that is also narrower than the corresponding curve on the tension clamp 1. An area of the respective torsional section 108, 109 that extends laterally away from the allocated leg 104, 105 connects to this, which area is longer when viewed from above (FIG. 4) than the corresponding area of tension clamp 1. A further curve 108', 109' by means of which the torsional sections 108, 109 pass into the supporting arm 112, 113 connected to them in each case can be found in this area. The curvature radius of this angle 108', 109' is greater than the corresponding curve of the tension clamp 1 when viewed from above (FIG. 4) and extends over a larger angle range than in tension clamp 1. In this way, supporting arms 112, 113 of the tension clamp 101 starting from their connection to the respective allocated torsional section 108, 109 are aligned in the direction of the free, protruding base section 103 of the central section 102 of the tension clamp 101. The supporting arms 112, 113 have an area 112', 113' in which they are formed in a straight manner when viewed from above (FIG. 4). If a straight line is placed in the areas 112', 113' coaxial to the longitudinal axis of the areas 112', 113' when viewed from above (FIG. 4), these straight lines intersect at a point that lies on the front face V of the tension clamp 101 and the symmetrical axis S of the tension clamp 101. At the same time, the supporting arms 112, 113 are each designed to be curved in an arch-like manner in the area of their spring sections 114, 115 in the direction of the upper face O of the tension clamp 1 in each case.

The free ends 116, 117 of the supporting arms 112, 113 each end in a support section 118, 119 which connects to the respective spring section 114, 115 with which the supporting arm 112, 113 sits in the rails to be fastened in the respective rail fastening point on the foot (not shown) during use. Punctiform supporting zones 120, 121 are formed in each case on the lower face of the support sections 118, 119 allocated to the lower face U of the tension clamp 101 on the ends 116, 117 of the supporting arms 112, 113.

The support sections 118, 119 are shaped in a continuous curve starting from the respective spring section 114, 115 from the central section 102 laterally in an outwards direction such that they are nestled tangentially to a straight line aligned in parallel to the connection lines G. The length of the supporting arms 112, 113 is dimensioned such that the punctiform supporting zones 120, 121, when viewed from above (FIG. 4), lie in front of the base section 103 of the central section 102 in the direction of the front face V of the tension clamp 101

As a result of the outwards-facing arrangement of the support sections 118, 119 and the corresponding lateral external punctiform supporting zones 120, 121 of the supporting arms 112, 113, the connection lines G1, G2, which on the one side (connection line G1) connect the center Z110 of the supporting zone 110 of the torsional section 108 to the punctiform supporting zone 120 which therefore also reflects the center of the supporting arm 112 connected to the torsional section 108 and on the other side (connection line G2) connects the center Z111 of the supporting zone 111 of the torsional section 109 to the punctiform supporting zone 121 which therefore also reflects the center of the supporting arm 113 connected to the torsional section 109 are arranged at an acute angle ß1 relative to the symmetrical axis S of the tension clamp 101 and enclose an angle ß2 of around 60°. Accordingly, when viewed from above (FIG. 4) they intersect at a point of intersection SG that lies behind the rear face R of the tension clamp 101.

The distance AS between the punctiform supporting zones 120, 121 that form their own center of the supporting arms 112, 113 measured in parallel to the symmetrical axis S on the one side and the point of intersection SG on the other side corresponds to around 1.7 times the distance AG of the punctiform supporting zones 120, 121 from the centers Z110, Z111 of the supporting zones 110, 111 of the torsional sections 108, 109 that is also measured in parallel to the symmetrical axis S. In practice, the distance AG can for example be approximately 100 mm and the distance AS approximately 150 mm, wherein the distance AS can also be varied in a range from for example 130 mm to 170 mm if this is expedient with respect to the setting of the natural frequencies or on the basis of structural circumstances.

Practical tests have shown that the tension clamp 101 has a 50% higher natural frequency than a conventionally shaped tension clamp 101 designated Skl15 and described in the above-mentioned brochure "System 300 highly elastic rail fastening for conventional and high speed—the proven solution for slab tracks".

Figure 8:
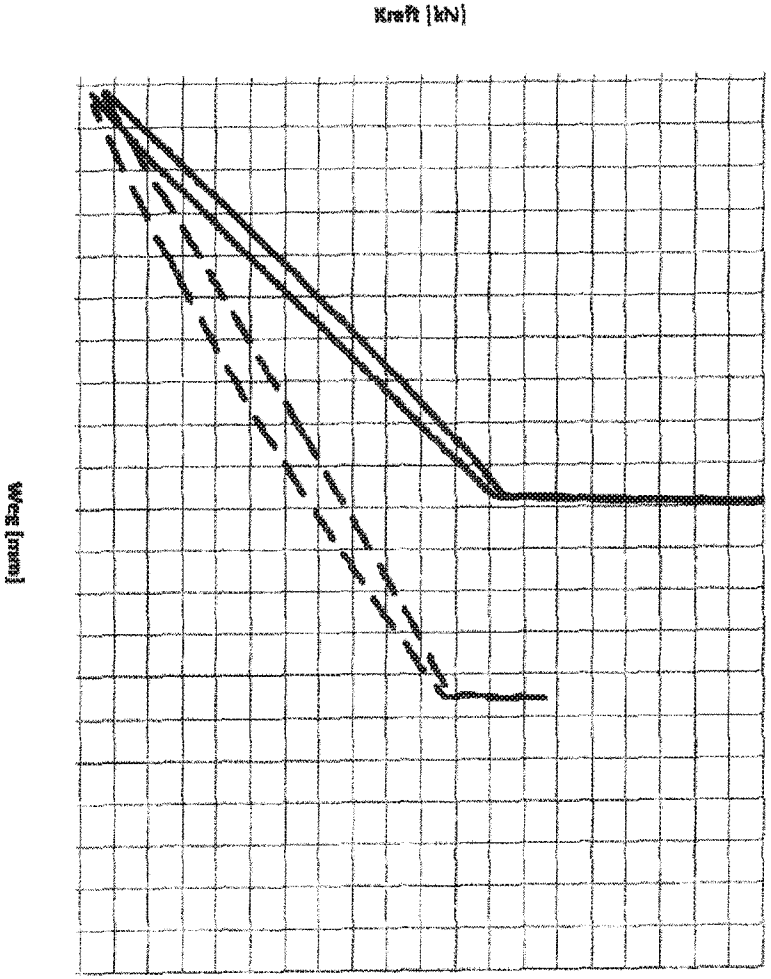
FIG. 8 a diagram showing a force-path characteristic curve for a conventional tension clamp as shown in FIGS. 4-7.

The force-path characteristic curves of the second loading and unloading determined in the tests are shown in FIG. 8, wherein the characteristic curve of the conventional tension clamp Skl15 is shown as a solid line and the characteristic curve of the tension clamp 101 according to the invention is shown as a dashed line.

It is demonstrated that the characteristic curve of the tension clamp 101 according to the invention has a flatter gradient, which has a favorable effect on the durability of the tension clamp 101. As a result of this, the tension clamp 101 not only has improved natural frequency behavior compared to the conventional Skl15, but also has improved durability. In other words, the tension clamp 101 according to the invention can tolerate significantly greater levels of deformation than the conventional tension clamp Skl15.

The characteristic values "natural frequency", vertical durability and the gradient of the characteristic curve of the tension clamps determined in the tests on the conventional tension clamp Skl15 and the tension clamp 101 according to the invention can be found in Table 1.

In order to determine the natural frequency, modal analyses were initially carried out using the Finite Element Method "FEM" and the results obtained were then verified by means of measurements carried out on the test stand and on the platform.

The vertical durability was determined using the DBS918127 standard by Deutsche Bahn AG of June 2010 (DB Standard), chapter 5.3 "Vertical durability".

The natural frequency determined for the tension clamp 101 is so high that even under unfavorable conditions of use, for example in tunnels or on bridges, there will not be any stimulation of the tension clamp 101 in the range of its natural frequencies.

TABLE 1

| | SKL15 | Tension clamp 101 |
|---|---|---|
| First natural frequency | 500-600 Hz | 900-1000 Hz |
| Vertical durability | 3 mm | at least 5 mm |
| Gradient of the characteristic curve | 0.7-0.8 mm/kN | 0.3-0.4 mm/kN |

The invention claimed is:

1. A tension clamp for elastically holding down a rail for rail vehicles, the rail comprising a foot, a web that is supported on the foot and a rail head carried by the web, the tension clamp comprising:

a loop-shaped central section, with two legs and a base section that connects the legs to one another, wherein a free end face of the base section faces a front face, a free upper face of the loop-shaped central section faces an upper face of the tension clamp and the legs of the loop-shaped central section face with their ends, which face away from the base section, face a rear face of the tension clamp, two torsional sections, one of which in each case is connected to an end of one of the legs of the loop-shaped central section that faces away from the base section, wherein the two torsional sections lead away laterally in an outwards direction in each case starting from the leg that is allocated to the two torsional sections respectively and wherein the torsional sections have a supporting zone on a lower face by means of which the tension clamp is supported on a component that bears them during use; and two supporting arms, one of which in each case is connected to an end of one of the two torsional sections that faces away from the allocated leg of the loop-shaped central section, wherein the supporting arms run in the direction of a front face of the tension clamp and in each case have a spring section curved towards an upper face of the tension clamp and a support section that ends at a free end of the supporting arm, the free end of which support section has a supporting zone by means of which the supporting arm in question is supported on the foot of the rail to be fastened during use, wherein the support sections of the supporting arms and the free ends thereof each point laterally outward relative to the loop-shaped central section of the tension clamp such that when the tension clamp is viewed from above straight lines that connect the center of the supporting zones of the supporting arms to the center of the supporting zone of the torsional section allocated to the respective supporting arm intersect in an area located on the rear face of the tension clamp, and wherein for a distance, AS, measured parallel to a symmetrical axis of the tension clamp between the center of the supporting zones of the supporting arms and a point of intersection of the straight lines which connect the center of the supporting zones of the supporting arms respectively to the center of the support zones of the torsional section allocated to the respective supporting arm and for a distance, AG, that is also measured parallel to the symmetrical axis between the supporting zones of the supporting arms and the centers of the supporting zones of the torsional sections, the following applies:

$$1.2 \times AG \leq AS \leq 1.8\ AG.$$

2. The tension clamp according to claim 1, wherein an angle enclosed between the straight lines when the tension clamp is viewed from above is at least 60°.

3. The tension clamp according to claim 1, wherein an angle enclosed between the straight lines when the tension clamp is viewed from above is a maximum of 120°.

4. The tension clamp according to claim 1, wherein the supporting arm runs in an outwards direction from the loop-shaped central section starting from the torsion section allocated to the supporting arm when the tension clamp is viewed from above.

5. A tension clamp according to claim 1, wherein the supporting arm runs in an inwards direction in the direction of the base section of the loop-shaped central section starting from the torsion section allocated to the supporting arm when the tension clamp is viewed from above.

6. The tension clamp according to claim 5, wherein the supporting arm runs in a straight line over at least part of the length of the supporting arm's spring sections.

7. The tension clamp according to claim 1, wherein, in the case of the supporting arms, the spring section transitions into a continuous curved line in the allocated support section.

8. The tension clamp according to claim 1, wherein when the tension clamp is viewed from above, the supporting zones of the supporting arms protrude relative to the free front face of the base section of the central section in the direction of the front face of the tension clamp.

9. The tension clamp according to claim 1, wherein the following applies for the distance AG and the distance AS:

$$1.3 \times AG \leq AS \leq 1.7\ AG.$$

10. A fastening point in which a fastening point for a rail vehicle is fastened on a ground, wherein a tension clamp designed according to claim 1 is provided for exerting an elastic holding force on the rail.

11. The tension clamp according to claim 1, wherein an angle enclosed between the straight lines when the tension clamp is viewed from above is at least 90°.

* * * * *